United States Patent [19]

Jackson

[11] 4,150,804

[45] Apr. 24, 1979

[54] COLLAPSIBLE KITE

[76] Inventor: Richard R. Jackson, Eight Trinity Rd., Marblehead, Mass. 01947

[21] Appl. No.: 840,540

[22] Filed: Oct. 11, 1977

[51] Int. Cl.[2] ..... B64C 31/06

[52] U.S. Cl. ..... 244/153 R; 403/109

[58] Field of Search ..... 244/153 R, 153 A, 155, 244/155 R, 155 A, DIG. 1; D34/15 AF; 46/77; 403/109, 291, 377

[56] References Cited

U.S. PATENT DOCUMENTS

| | | | |
|---|---|---|---|
| 671,865 | 4/1901 | Mower | 244/153 R |
| 2,537,560 | 1/1951 | Wanner | 244/153 R |
| 2,992,845 | 7/1961 | Blanchard | 403/377 |
| 3,570,791 | 3/1971 | Jackson | 244/153 R |
| 3,697,023 | 10/1972 | Jackson | 244/153 R |
| 3,791,611 | 2/1974 | Babbidge | 244/153 R |
| 3,860,350 | 1/1975 | Rogers | 403/377 |
| 3,947,141 | 3/1976 | Casset | 403/109 |

FOREIGN PATENT DOCUMENTS

| | | | |
|---|---|---|---|
| 569841 | 6/1945 | United Kingdom | 244/153 R |
| 1267933 | 3/1972 | United Kingdom | 244/153 R |

*Primary Examiner*—Galen L. Barefoot

[57] ABSTRACT

In a ready-to-fly kite having a central, longitudinal stiffening element and a flexible kite body that defines a pair of flexible wings, the axial stiffening element is comprised of a plurality of elongated stiff sections. These sections are connected together to fold relative to one another at a joint from an extended position in which the sections are axially aligned, end to end, to a folded position in which the sections lie side by side. The respective sections of the flexible kite body that correspond to the stiffener sections are free from axial restraint to permit folding of the flexible kite body sections with the stiffener sections. Also the flexible kite body sections are free from lateral restraint to permit rolling of the kite body sections together about the folded group of stiffener sections to provide a compact portable collapsed kite package.

4 Claims, 16 Drawing Figures

FIG 2
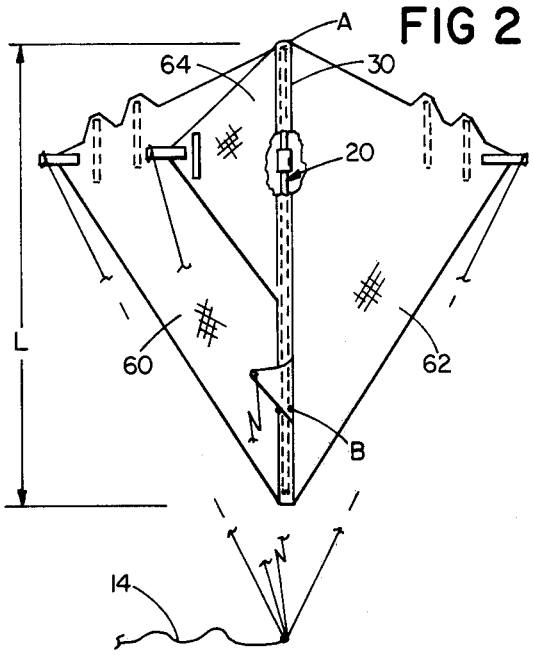
FIG 1
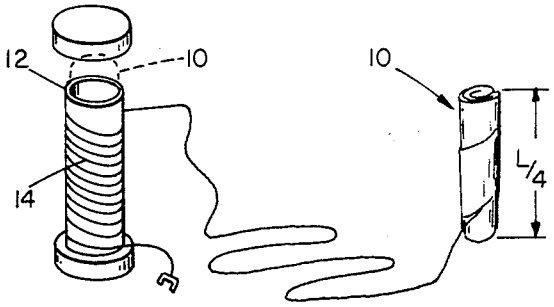
FIG 1d
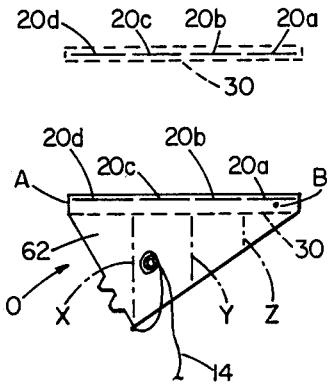
FIG 1c
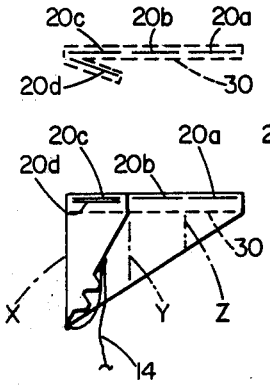
FIG 1b
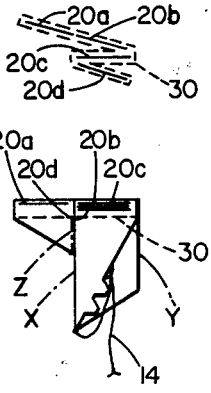
FIG 1a
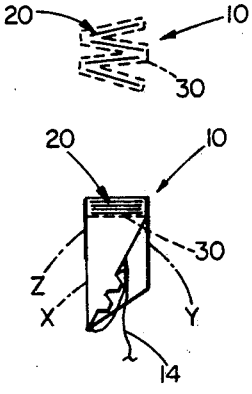
FIG 10
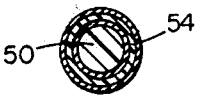
FIG 11
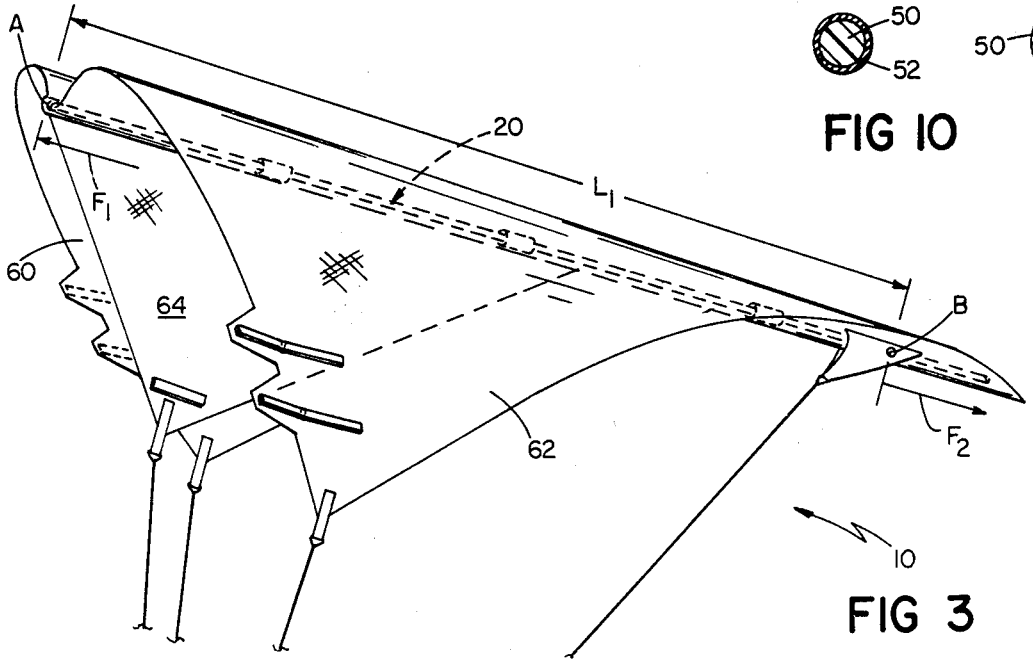
FIG 3

FIG 5
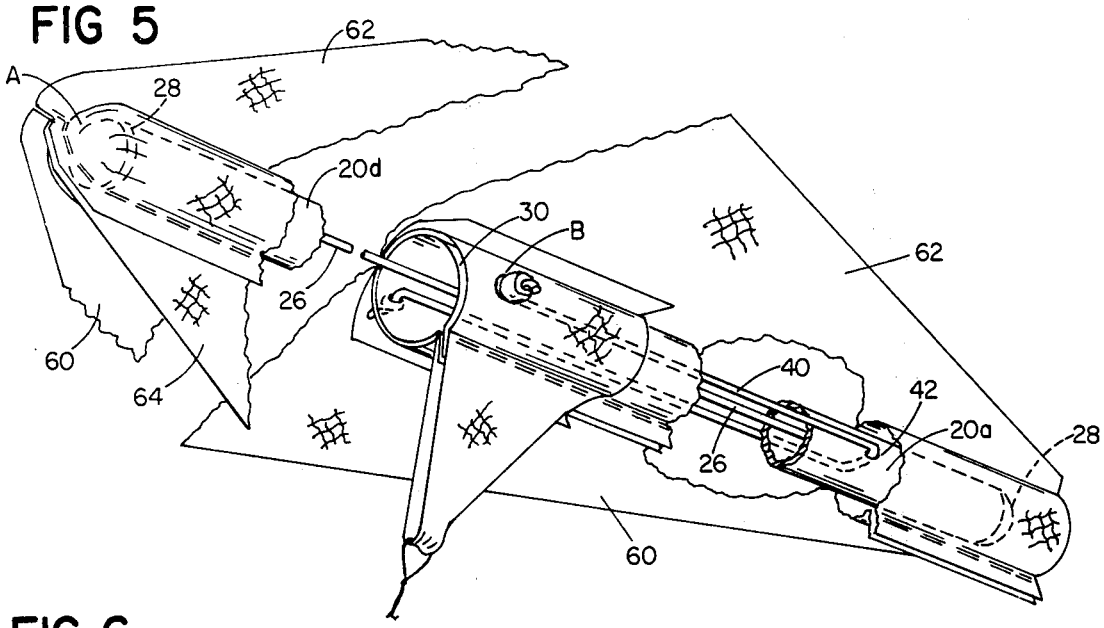
FIG 6
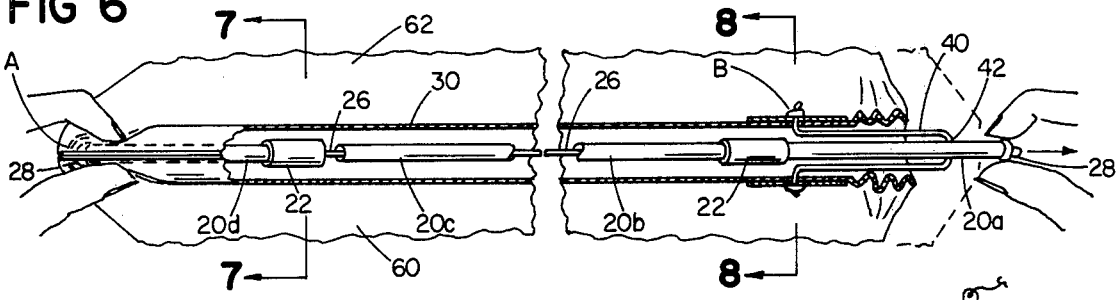
FIG 9
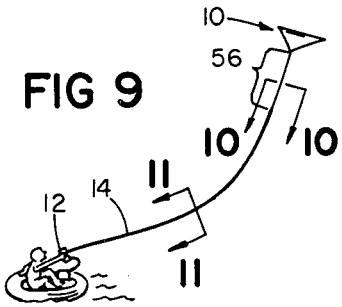
FIG 7
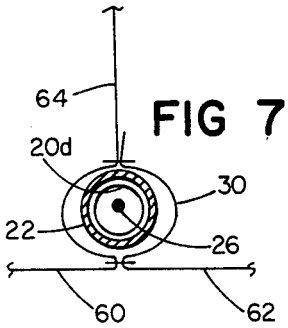
FIG 8
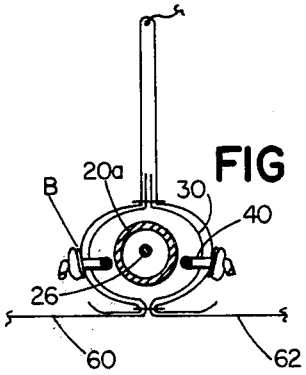
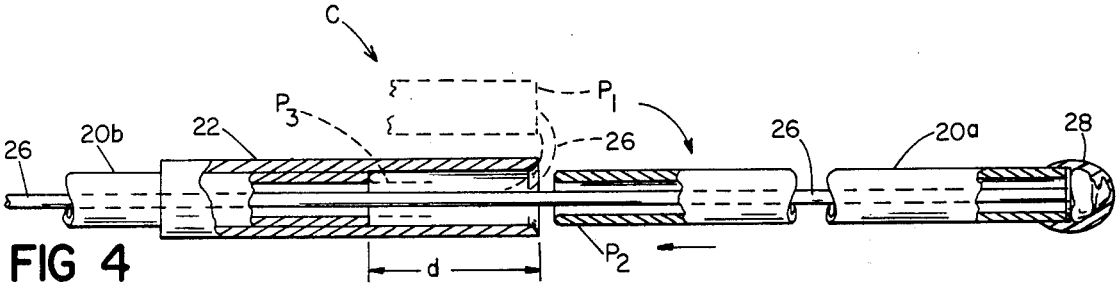
FIG 4
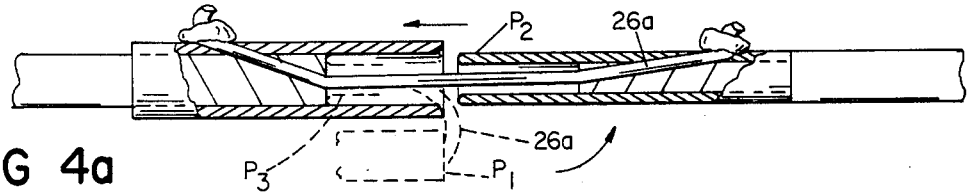
FIG 4a

COLLAPSIBLE KITE

BACKGROUND OF THE INVENTION

This invention provides longitudinally collapsible kites capable of being folded into compact durable packages and capable of reliable performance over a wide range of wind conditions. In one form the invention provides a "rescue" kite capable of being assembled and launched under adverse circumstances to carry aloft a radio antenna or radar reflector for communication with rescuers or others.

Kites, due to their flimsy nature and need for long elements, are delicate and difficult to transport or store. On the other hand they are aerodynamically of sensitive design, and therefore difficult to construct in form suitable for wide-ranging wind conditions.

In my U.S. Pat. No. 3,570,791, I provided a kite employing a collapsible air-filled tubular keel. While this construction has proved operable, under certain circumstances the relatively large tube has adversely affected performance either in launch or in flight. Among the objects of the invention are to provide an aerodynamically superior, longitudinally collapsible kite, and to provide a portable radio antenna kite package suitable for use by persons at sea or in the wilderness, as well as in recreational applications.

SUMMARY OF THE INVENTION

According to the invention a longitudinally extending sleeve formed of flexible sheet form material extends integrally along a flexible kite body and an elongated, collapsible stiffening element is freely received within this sleeve. When the stiffening element is in its opened position, a resilient interconnection is provided between the ends of the stiffening element to a slightly shorter span of the kite body, placing the longitudinal span of the kite body material under tension.

The invention also features the collapsible stiffening element in the form of a plurality of longitudinally stiff rod form segments with an axial fitting between mating ends of the segments effective to connect the segments in alignment along an axis while providing lateral stiffness at the connections. Resilient means are preferably provided to urge the segments axially together to maintain cooperative stop surfaces of the individual segments in contact with each other, to maintain the axial connections during flight. Preferably, this resilient means comprises an elongated resilient strand secured between adjacent rod form segments and extending axially across the connection between adjacent segments, with the resilient strand being under tension during flight. In one preferred form of such construction three or more of the rod segments are provided, each being a hollow tube, the tubes having end portions sized to telescopically interfit, and a resilient strand extends internally throughout the length of these segments, serving to join the entire assemblage.

Another feature of the invention is such a kite in which the collapsible stiffening element is permanantly disposed within the sleeve of the kite body, the connections adapted to be made and unmade by manipulation of the stiffening elements together with the kite body to which they are attached.

Another feature of the invention is a kite of the keel type construction, such as shown in my previous U.S. Pat. No. 3,697,023, in which the collapsible stiffening element forms the keel of the kite, and the kite body forms flexible wings extending to either side of this keel, these wings being collapsed and folded, and together with the collapsed stiffening element forming a compact, readily portable package. The resilient tension applied to the kite body along the keel produces an aerodynamically stable, smooth surface, resulting in excellent flight performance.

These and other objects and features of the invention will be understood from the following description of the preferred embodiment taken in conjunction with the drawings wherein:

FIG. 1 is a perspective view of the collapsed kite package and FIGS. 1(*a*) through 1(*d*) illustrate diagramatically the expansion of the kite from the collapsed package to the full kite form (Each FIG. 1(*a*) through 1(*d*) is a set of edge and side views).

FIG. 2 is a plan view and FIG. 3 a perspective view of the kite of FIG. 1 in flying condition;

FIGS. 4 and 4(*a*) show alternate means of construction of the connections between adjacent stiffening element segments of the kite;

FIG. 5 is a partial perspective view on an enlarged scale relative to that of FIGS. 2 and 3 giving end details of the interconnection of the stiffening element with the kite body;

FIG. 6 illustrates the final steps of assembling the kite stiffening element in the body of the kite while FIGS. 7 and 8 are cross-sectional views taken on respective lines in FIG. 6;

FIG. 9 is an illustration of the kite employed by a survivor of a wreck at sea while FIGS. 10 and 11 give details about the kite string employed in FIG. 9.

Referring to FIG. 1, a collapsible kite package is shown in which the collapsed kite 10 is shown in dotted lines as inserted in the protective case 12 and in full lines in the removed condition. The protective case 12 is simply a rigid, waterproof tube having a removable end cap and having the desired length of kite string 14 wound upon its exterior. The collapsed kite package has length L/4.

FIGS. 1(*a*) through 1(*d*) depict steps of unfolding the collapsed kite, from the collapsed position of FIG. 1(*a*) to the fully extended position of 1(*d*). The stiffening element 20 is comprised of four rod-form stiffening segments 20(*a*) through 20(*d*) which are shown in collapsed, parallel, serpentine array in FIG. 1(*a*) progressing to the extended axially aligned position of FIG. 1(*d*). By the outline of the kite body shown in dotted lines in FIGS. 1(*a*) through 1(*c*), these figures illustrate the fact that the stiffening element, even in its collapsed condition, is contained within the body of the kite and is manipulated into the fully extended position in this condition. In the fully-extended position, stiffening element applies tension forces at points A and B at opposite ends of the axis of the body of the kite, enabling the material to assume the uniform, billowed air-foil shape as shown in FIG. 3. (For details as to the construction of the body of the kite, reference is made to my U.S. Pat. No. 3,697,023, incorporated herein by reference.)

The features which permit the unique assembly in the present embodiment are depicted in FIGS. 4 through 8. Referring to FIG. 4, the rod-form segments 20(*a*) through 20(*d*) comprise hollow tubes adapted to be joined at connections C. At each connection a rigid larger connecting tube 22 is secured about the lower end of e.g. rod 20(*b*) and protrudes beyond it a distance d forming a receptacle for sliding fit of the mating end of rod 20(*a*). It provides lateral stiffness at the joint. An elastic strand element 26 extends from a securing knob 28 at the lower end of segment 20(*a*), through the length of the segment, bridges the connection, and extends through the length of segment 20(*b*) and thus through the remaining segments to a similar termination at the opposite end of the kite. In the collapsed position, the segments lie side-by-side as shown in dotted lines in FIG. 1(*a*) with the strand bent 180° at the joints as shown. The stiffening element segments 20(*a*) through 20(*d*) are disposed in corresponding parts of kite sleeve 30 which is integral with the sheet form material of the kite. The sleeve is folded along with the segments, with the wings of the kite appropriately collapsed.

During assembly, the wings of the kite are unwound from about the package of FIG. 1 to the position shown in FIG. 1(*a*). Then as the stiffening segments 20(*a*) through 20(*d*) are unfolded from the position of FIG. 1(*a*), the sleeve of kite material and the wings simiarly unfold. In the fully extended position, the sheet form body material of the kite is freed of gross folds.

After unfolding the segments, as soon as the two rod segments 20(*a*), 20(*b*) are manipulated into axial alignment and released to the influence of the resilient strand 26, the elastic tension pulls the segments together with the ends of the tubes hitting each other as shown in position P3. Each pair of segments is seated in turn within a connecting tube 22.

During this assembly, as has been mentioned, the stiffening element resides in sleeve 30. In the preferred embodiment the kite body is formed of sail cloth, and sleeve 30 comprises a folded and stitched pocket extending throughout the axis of the kite. Sleeve 30 is closed at end A, at the top of the kite, and forms a compression pocket against which the end of the stiffening element can press to apply upward force $F_1$, to the kite material.

The lower-most rod of the stiffening element, segment 20(*a*), is secured at 42 to a further elastic strand 40 which extends upwardly a short distance along the segment to a connection point B to the sheet form body of the kite. The dimensions are such that when all segments 20(*a*) through 20(*d*) are snugly seated and the operator releases the segments from the grasp shown in FIG. 6, tension remains on strand 40, applying tension force $F_2$ upon the kite material at point B, see FIGS. 3 and 6. The compression force thus applied by the stiffening element at A and the tension force applied at point B place the kite body under tension throughout the major length L of the kite. This tensions the loose kite material throughout this length, preventing wrinkles and assuring that the kite material will assume the aerodynamic billowed wing form shown in FIG. 3.

The small remaining kite cloth downward from point B shown in gathered form for purposes of assembling, will straighten sufficiently during flight and, being in an insensitive region, will not adversely affect flight capabilities.

The segments of FIG. 4 are formed of lightweight metal tubes. In FIG. 4(*a*), wooden rods are shown having metal tubular ends for forming the connections. In this case individual elastic strands 26(*a*) are provided for the respective points.

The resulting kite has an unusually good performance capability. As depicted in FIG. 9 even in a very light breeze the kite can be launched from a confined area, for instance a life raft. The kite string can in fact be a long length of stainless steel wire to act as an antenna. As shown, instead it is a plastic filament 50 having a vacuum deposited metal layer 52, with a layer of insulation 54 up most of the length, the exposed part at 56 forming a dipole antenna.

In one embodiment the kite is water-resistant formed of ¾ ounce weight sail cloth which is durable, strong for high winds, and capable of being readily stitched to form the sleeve 30 as shown in FIG. 7. In this preferred form the sleeve is sewn larger in diameter than the rod segments, providing freedom for relative adjusting movement between the stiffener segments and the sleeve during the assembly procedure.

There is a very advantageous cooperation between the keel type, bilowing wing kite construction in which only the single elongated keel stiffener is employed. During assembly the fully assembled stiffener may be inserted in the sleeve 30 with elastic 26 or elastics 26(*a*) in place, and the elastic 40 may then be installed. Then by grasping the keel, held horizontally, both wings 60, 62 and the heel 64 will hang down vertically together as shown in FIG. 1(*d*). By applying manual tension to the stiffener with hands as shown in FIG. 6, the segments can be detached and folded together in the horizontal plane through the reverse sequence from FIGS. 1(*c*) to 1(*a*). Sleeve 30 and the wings fold along lines X, Y, and Z, as the segments are brought together. Then the various folded layers of the kite material can be wrapped spirally about the folded central assembly to form the compact package of FIG. 1. For assembling the kite the reverse procedure is employed.

It will be understood that numerous variations in the specific details will be possible within the spirit and scope of the following claims.

What is claimed is:

1. In a ready-to-fly, heavier than air kite having a single spar in the form of a central, longitudinal stiffening element extending over the axial length of the kite, and a flexible kite body of sheet-form material extending laterally without support by additional stiff elements from said stiffening element to opposite sides thereof to define a pair of flexible wings, each wing capable of assuming a billowed form during flight, the improvement wherein said single, central stiffening element is comprised of a plurality of elongated stiff sections, said sections connected together to fold relative to one another at a joint from an extended position in which said sections are axially aligned, end to end, to a folded position in which said sections lie side by side, said stiffener sections being permanently installed relative to the respective sections of said flexible kite body that correspond in axial position to said stiffener sections, said flexible kite body portions being free from restraint to permit folding of said flexible kite body sections with said stiffener sections, and said flexible kite body sections being free from lateral restraint to permit wrapping of said kite body sections together about the folded group of stiffener sections to provide a compact portable collapsed kite package, whereby said kite is ready to fly by the simple steps of unfolding the collapsed kite, and bringing said stiffener sections into axially aligned relation, the kite body portions thereupon being free to billow out from said central element.

2. The kite of claim 1 wherein said stiffener sections are disposed within an axially extending sleeve joined to said sheet form kite body, said sleeve adapted to fold with said stiffener sections.

3. The longitudinally collapsible kite of claim 1 wherein said stiffening element comprises a plurality of longitudinally stiff rod form segments, an axial fitting between mating ends of said segments, effective to connect said segments in alignment along an axis and providing lateral stiffness at said connection, said connections adapted to be made by manipulation of said stiffening segments together with the kite body to which they are attached.

4. In a ready-to-fly, heavier than air kite having a central, longitudinal stiffening element extending over the axial length of the kite, and a flexible kite body of sheet-form material extending laterally from said stiffening element to opposite sides thereof to define a pair of flexible wings, each wing capable of assuming a billowed form during flight, the improvement wherein said axial stiffening element is comprised of a plurality of elongated stiff sections, said sections connected together to fold relative to one another at a joint from an extended position in which said sections are axially aligned, end to end, to a folded position in which said sections lie side by side, the respective sections of said flexible kite body corresponding in axial position to said stiffener sections being free from axial position to said stiffener sections being free from axial restraint to permit folding of said flexible kite body sections with said stiffener sections, and said flexible kite body sections being free from lateral restraint to permit rolling of said kite body sections together about the folded group of stiffener sections to provide a compact portable collapsed kite package and wherein said stiffener sections are disposed within an axially extending sleeve joined to said sheet form kite body, said sleeve adapted to fold with said stiffener sections, and wherein said stiffening element comprises a plurality of longitudinally stiff rod form segments, an axial fitting between mating ends of said segments, effective to connect said segments in alignment along an axis and providing lateral stiffness at said connection, said collapsible stiffening segments being permanently disposed within said sleeve, said connections adapted to be made by manipulation of said stiffening segments together with the kite body to which they are attached.

* * * * *